US006070652A

United States Patent [19]

Schildmann et al.

[11] Patent Number: 6,070,652

[45] Date of Patent: Jun. 6, 2000

[54] LOCK FOR BALLS FOR CLEANING COOLING SYSTEMS

[75] Inventors: Hans-Werner Schildmann, Heiligenhaus; Hartono Widjaja, Wetter, both of Germany; Peter Schink, Cardona, Spain

[73] Assignee: Taprogge GmbH, Germany

[21] Appl. No.: 09/202,851

[22] PCT Filed: Jun. 19, 1997

[86] PCT No.: PCT/EP97/03202

§ 371 Date: Apr. 28, 1999

§ 102(e) Date: Apr. 28, 1999

[87] PCT Pub. No.: WO97/49965

PCT Pub. Date: Dec. 31, 1997

[30] Foreign Application Priority Data

Jun. 21, 1996 [DE] Germany ..... 296 10 900 U

[51] Int. Cl.[7] ..... F28G 1/12

[52] U.S. Cl. ..... 165/95; 15/3.5

[58] Field of Search ..... 165/95; 15/3.51, 15/3.5

[56] References Cited

U.S. PATENT DOCUMENTS 5,630,471 5/1997 Taprogge ..... 165/95

FOREIGN PATENT DOCUMENTS 148509 7/1985 European Pat. Off. ..... 165/95
1247359 8/1967 Germany ..... 165/95
356697 12/1992 Japan ..... 165/95
280890 10/1993 Japan ..... 165/95

*Primary Examiner*—Leonard Leo
*Attorney, Agent, or Firm*—Snell & Wilmer L.L.P.

[57] ABSTRACT

The invention relates to a ball collector for a device for returning balls for the cleaning of the tubes of cooling systems operated with a fluid, namely water, comprising a casing which is subdivided into an upper chamber with an inlet for the balls and a lower chamber with an outlet for the balls, in which between the upper and the lower chambers is provided an opening which can be closed by a movable flap in the closed position thereof and can be opened in the open position thereof, the upper chamber having a strainer screen being connected to the lower chamber by a bypass line having a pump, through which water can be pumped from the upper chamber into the lower chamber. To simplify the necessary drives and the associated controls for the ball collector, the flap of the ball collector is so arranged and pivotably mounted such that it can be moved from its open position to its closed position and vice versa by the water flow being caused by the pump in the bypass line, so that the flap assumes its closed position when the pump is switched on and its open position when the pump is switched off.

12 Claims, 3 Drawing Sheets

LOCK FOR BALLS FOR CLEANING COOLING SYSTEMS

DESCRIPTION

1. Technical Field of the Invention

The invention relates to a ball collector for a device for returning balls for the cleaning of the tubes of cooling systems operated with a fluid, preferably water, which are e.g. used in heat exchangers, power station condensers, refrigerating and air conditioning plants, etc., comprising a casing, which is subdivided into an upper chamber with an inlet for the balls and a lower chamber with an outlet for the balls, in which between the upper and lower chambers is provided an opening, which is closable by a movable flap in the closed position thereof and is freeable in the open position thereof, the upper chamber having a strainer screen is connected to the lower chamber by a bypass line having a pump, through which water can be pumped from the upper chamber into the lower chamber.

2. Background of the Invention

A ball collector of the aforementioned type is known from the applicant's German publication G 93 09 320.9. In the case of the known ball collector the opening between the upper and lower chambers is closed and opened by a flap, which is mounted in rotary manner about its centre axis in the opening plane and is adjusted by a motor placed on the casing from the closed to the open position and vice versa. The flap motor requires a control, in order to maintain periodically predetermined cleaning cycles or cycles dependent on the fouling factor of the heat exchanger tubes and in order to bring about the necessary synchronization with the pump motor located in the bypass line.

At the start of a cleaning cycle the flap motor is switched on, so that the flap passes from the closed position into the open position and frees the opening between the upper and lower chambers. The balls collected in the upper chamber sink into the lower chamber, because their specific gravity is slightly above that of water. Following the sinking of the balls into the lower chamber the flap is again motor-closed, e.g. following the operation of a previously set time-lag relay.

The pump in the bypass line is then switched on and its delivery pressure opens the fluid pressure-controlled shutoff member in the discharge line and must additionally overcome the dynamic (line-caused speed losses) pressure heads and the static ($\Delta$ p of the condenser) pressure heads of the system. The pump sucks water out of the upper chamber and pumps it into the lower chamber, so that the balls in the lower chamber are conveyed into the discharge line and through the latter to the inlet area of the heat exchanger, where they are taken up by the main cooling water flow. After passing through the heat exchanger tubes, the balls are collected by the strainer in the outlet area of the heat exchanger and passed via the supply line into the upper chamber of the ball collector casing. The transportation of the balls through the discharge line and through the supply line is ensured by the pump in the bypass line, into which no balls can pass, because in the upper chamber a strainer screen is placed in front of the bypass line inlet. In addition, the differential pressure prevailing between the inlet and outlet areas of the heat exchanger acts on the ball-transporting water flow in the supply line and the discharge line.

When all the balls have finished the circulation, the pump is switched off again and the device is ready for the next cleaning cycle.

In the known ball collector the drives of the flap and the pump are operated by sequence controls or circuits. In the rest periods the fluid pressure-controlled valve in the discharge line ensures that no undesired bypass flow of of the heat exchanger takes place.

The known ball collector and the device for returning the balls and in which the ball collector is located require only two drives, namely for the pump in the bypass line and for opening and closing the flap.

SUMMARY OF THE INVENTION

The problem of the invention is to simplify the necessary drives and the associated controls for the ball collector.

According to the invention this problem is solved in that the flap of the ball collector is so constructed and positioned and freely pivotably mounted through the water flow between the open position and the closed position that if the pump in the bypass line is switched on the flap assumes its closed position and when the pump is switched off its open position.

According to the invention, the flap with which the opening between the upper and lower chambers can be closed and released is not, as in the known ball collector, motor-operated, i.e. by an electric, hydraulic or pneumatic motor, but instead by the water flow in the casing. For this purpose the flap is freely pivotably mounted between the open and closed positions and is so constructed and arranged that it is operated by the water flow, which passes from the bypass line into the lower chamber when the pump is switched on, namely being brought into its closed position, if the pump drive in the bypass line is switched on and returns to the open position when the pump is switched off and consequently the water flow from the bypass line into the lower chamber stops.

Unlike in the known ball collector, according to the invention during the rest period between two cleaning cycles the flap is not in the closed position and the balls at the end of a cleaning cycle are not in the upper chamber as in the known ball collector and instead, according to the invention, the rest state at the end of a cleaning cycle is only reached when the flap, after the disconnection of the pump, returns to its open position and the balls, due to their specific gravity, which is slightly higher than that of water, have sunk from the upper chamber through the opening into the lower chamber.

For initiating a new cleaning cycle the sole drive provided for the ball collector and for the ball return device, namely the pump drive, is switched on, so that in the discharge line the motor-operated or preferably fluid-operated shutoff member, preferably a nonreturn valve, opens under the delivery pressure produced by the pump. Under the action of the water flow from the bypass line, the flap in the ball collector assumes its closed position and the balls are discharged by the water flow from the bypass line out of the lower chamber. By means of the discharge line they pass into the inlet area of the heat exchanger, where they are received by the cooling water flow.

The essential advantage of the inventive ball collector is that there is no need for the motor drive of the flap of the known ball collector. Including the reduced costs for control means, this economizes a considerable part of the costs for the drives and controls compared with the known ball collector. There is a consequent drop of maintenance and inspection activities, which hitherto occurred in connection with the flap drive. The reduction of costs for drives and controls is particularly important for smaller cleaning systems, e.g. for refrigerating, air conditioning and similar plants, because with smaller plants the costs for drives and controls represents a relatively high percentage of the total costs.

As a result of the aforementioned operating sequence of the ball collector according to the invention, it is advantageous if the flap is so constructed and arranged that the flap, if the pump in the bypass line is switched off at the end of a cleaning cycle, pivots from the closed position into the open position and frees the opening between the upper chamber and the lower chamber, so that the balls collected in the upper chamber sink into the lower chamber and pivots from the open position back up into the closed position and closes the opening, if at the start of a cleaning cycle the pump in the bypass line is switched on.

It is also advantageous for the invention that the flap relative to the inlet of the bypass line into the lower chamber is so positioned and constructed that in the open position, on switching on the pump, it is subject to the action of the water flow from the bypass line and forced into the closed position.

According to a development of the invention, for a reliable operation of the flap the size and weight of the flap on the one hand and the pressure of the pump on the other are so selected that the forces exerted by the water flow from the bypass line on said flap are high enough to bring it into a reliable closed position. This means that the pump must also overcome the static pressure loss between the heat exchanger inlet and outlet areas, as well as the dynamic pressure losses of the ball transporting lines.

According to the invention, it is possible to provide springs for assisting the pivoting movement of the flap. Through the use of springs forces acting on the flap can be produced, which would otherwise have to be attained on a design basis when deciding the size and weight of the flap, as well as during the arrangement thereof with respect to the bypass line inlet in the lower chamber.

The bypass fine can be displaced by 90° relative to the casing discharge line.

It is advantageous for the collection of the balls and for an undisturbed sinking of the collected balls into the lower chamber, that the strainer screen in the upper chamber has a substantially cylindrical construction, at least in the vicinity of the opening and for the shape and size of its free cross-section, at least at the lower end, to be adapted to the shape and size of the opening.

In order to create a free passage cross-section for the balls in the opening between the two chambers, according to a further development of the invention, the swivel bearing of the flap is fitted to the underside of an annular shoulder or web forming the opening. It is unimportant whether the web is connected to the casing or to the strainer.

BRIEF DESCRIPTION OF THE SEVERAL VIEWS OF THE DRAWINGS

An embodiment of the invention is described in greater detail hereinafter relative to the drawings, wherein show.

DETAILED DESCRIPTION OF THE INVENTION

Figure 1:
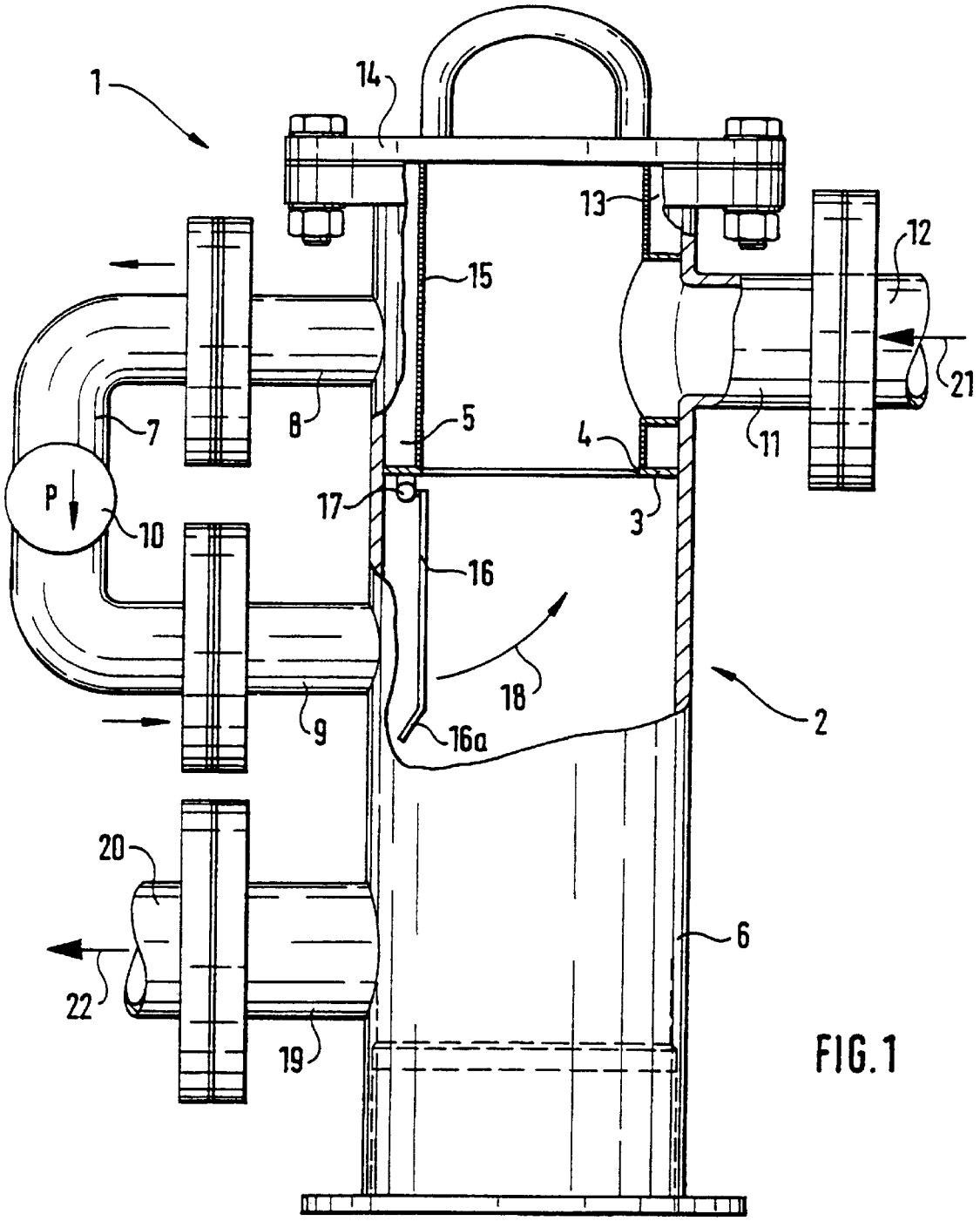
FIG. 1 A diagrammatic view of a ball collector as a vertical section.

The ball collector 1 shown in FIG. 1 has a substantially cylindrical casing 2, which is e.g. made from sheet steel or a material with comparable characteristics and is subdivided into an upper chamber 5 and a lower chamber 6 by an annular web 3, which forms an opening 4 and which is fixed internally to the casing 2.

A bypass line 7 with a pump 10 is connected by one end to an outlet 8 of the upper chamber 5 and by the other end to an inlet 9 of the lower chamber 6.

For the supply of balls for cleaning the tubes of a cooling system operated with a fluid, preferably water, use can be made of a supply line 12, which is connectable to an inlet 11 of the upper chamber 5 of the ball collector 1. For removing balls from the ball collector 1 use can be made of a discharge line 20, which is connectable to an outlet 19 of the lower chamber 6 of the ball collector 1.

Figure 4:
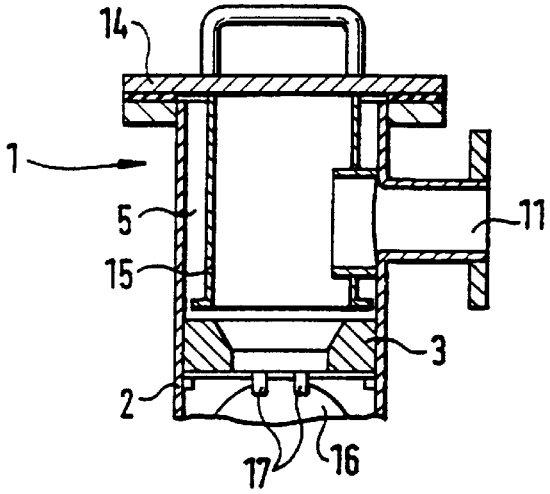
FIG. 4 A sectional view of part of a modified embodiment of the ball collector.
Figure 5:
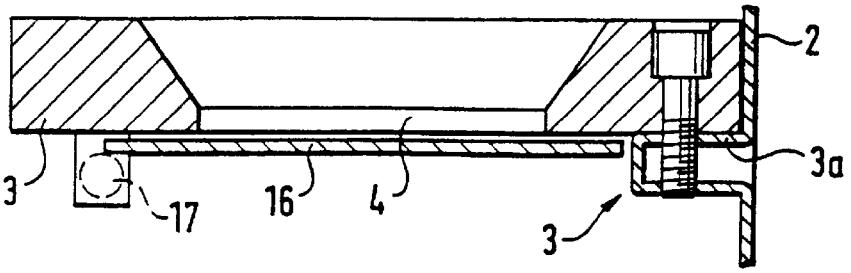
FIG. 5 A detail relative to FIG. 4.

The interior of the casing 2 is accessible by means of an opening 13 on the top of the upper chamber 5, which can be closed by a lid 14. A substantially cylindrical strainer screen 15 prevents the balls supplied through the inlet 11 from passing out of the upper chamber 5 into the bypass line 7, so that the pump 10 only delivers water, without balls, from the upper chamber 5 into the lower chamber 6. The strainer 15 is placed in a centred position on the web 3 and after the removal of the lid 14 can be extracted from the chamber 5. In the embodiment of FIG. 4 the strainer 15 is fixed to the underside of the lid 14 and can consequently be removed from the casing 2 on removing the lid 14. The web 3 is either screwed onto a casing projection 3*a* (right-hand part of FIG. 5) or, constructed as an expanding ring, is pressed and held firmly on the inner wall of the casing 2.

On the underside of the shoulder or web 3 is freely pivotably articulated by means of a bearing 17 a flap 16 and is so positioned with respect to the inlet 9, through which the water delivered by the pump 10 flows into the lower chamber 6, that if the ball collector 1 is filled with water and the drive of the pump 10 is switched on, under the action of the water flow the flap 16 is pivoted from the open position shown in FIG. 1 in the direction of the arrow 18 upwards into the closed position, in which it closes the opening 4. Like the flap 16, the opening 4 is substantially circular. At its end remote from the bearing 17 the flap 16 has a bevel 16*a* for increasing the effect of the flow from the inlet 9 on the flap 16.

At the start of a cleaning cycle the flap 16 is in the open position shown in FIG. 1. The balls are located in the lower chamber 6. As soon as the drive of the pump 10 is switched on, under the action of the water flow from the bypass line 7 directed against the flap 16, the latter pivots upwards into the closed position. As a result of the water flow from the bypass line 7, the balls are conveyed from the outlet 19 of the lower chamber 6 in arrow direction 22 into the discharge line 20, where a shutoff member not shown in FIG. 1 is opened at the start of the cleaning cycle, and from there through the device to be cooled, such as e.g. a heat exchanger, into the outlet area thereof, from where the balls are returned by means of a strainer screen not shown in FIG. 1 and the supply line 12 in arrow direction 21 back to the ball collector 1. They collect in the strainer 15 of the upper chamber 5, because the opening 4 is closed by the flap 16. At the end of the cleaning cycle the drive of the pump 10 is switched off. The water flow from the bypass line 7 stops. The discharge line 20 is normally closed by a not shown shutoff valve. Under the action of its gravity, the flap 16 pivots from the closed position back into the open position, after the water flow in the lower chamber 6 has stopped. The balls sink from the upper chamber 5 through the opening 4 into the lower chamber 6 and remain there to the start of the next cleaning cycle.

Figure 2:
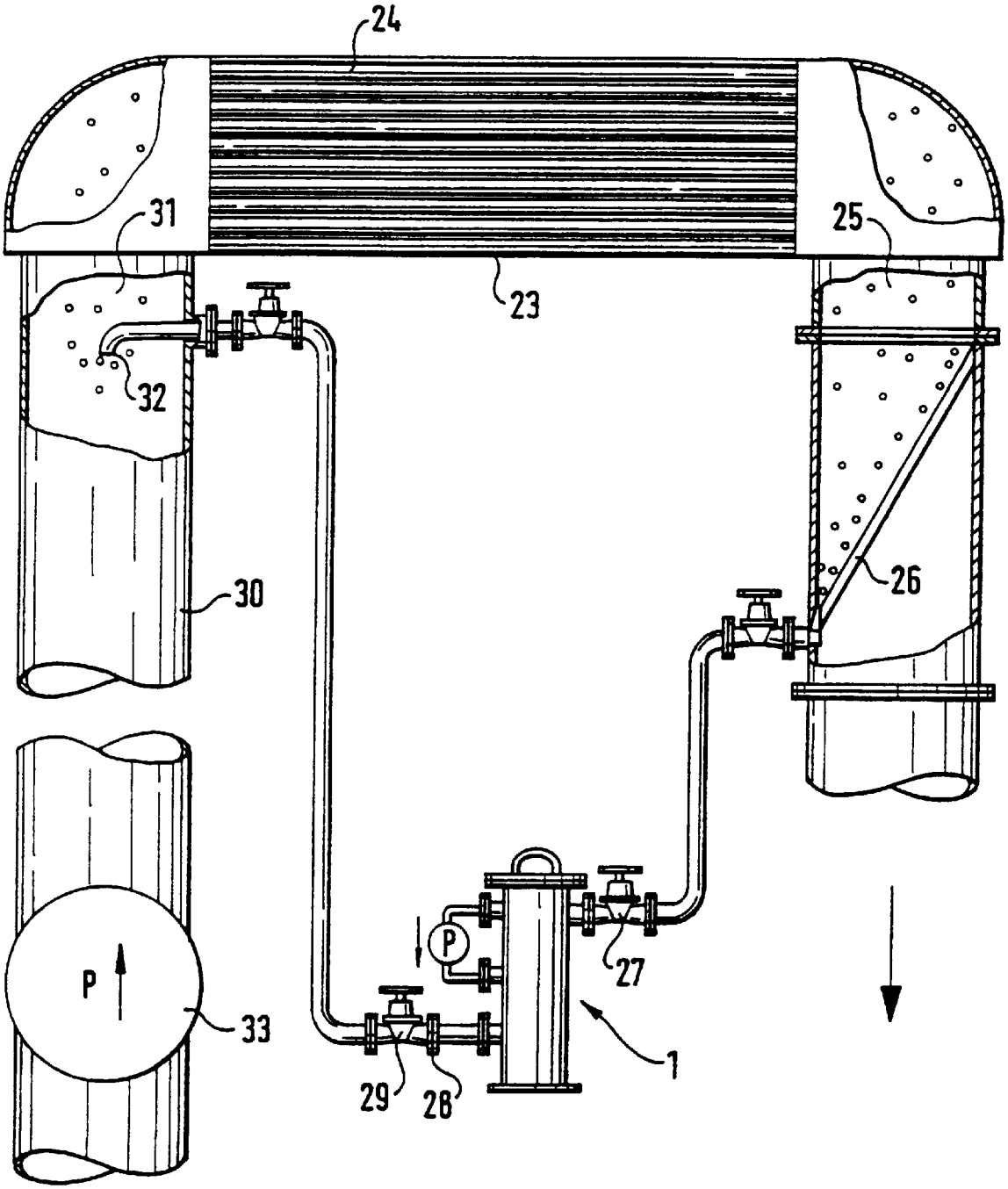
FIG. 2 A diagrammatic representation of a heat exchanger with a device for cleaning the tubes of the heat exchanger with balls and with a device for returning the balls, whilst incorporating a ball collector according to FIG. 1.

In the case of the embodiment diagrammatically shown in FIG. 2, a ball collector 1 of the type shown in FIG. 1 is arranged in conjunction with the return of balls of a device for cleaning the tubes 24 of a cooling water-operated heat exchanger 23. At the start of a cleaning cycle the drive of the pump 10 is switched on, so that the flap 16 assumes its closed position and the balls collected in the lower chamber 6 are conveyed via the discharge line 20, in which a fluid pressure-controlled nonreturn valve 28 has been opened by the delivery pressure of the pump 10 and via the outlet 32 into the cooling water line 30, where they are taken up by the main cooling medium flow, which has passed through the main pump 33. From the inlet area 31 of the heat exchanger 23 the balls traverse the tubes 24 of the heat exchanger 23 and finally pass into the outlet area 25, where they are discharged by the strainer 26 from the cooling medium flow and are returned via the supply line 12 to the ball collector 1. A shutoff valve 27 in the supply line 12 and a shutoff valve 29 in the discharge line 20 are used for shutting off said lines, e.g. if the lid 14 of the ball collector 1 is opened and the balls are replaced. The nonreturn valve 28 closes the discharge line 20 in the operating intervals between two cleaning cycles, in order to avoid undesired bypass flows of the cooling water between the outlet area 25 and the inlet area 31 during such inoperative periods.

Figure 3:
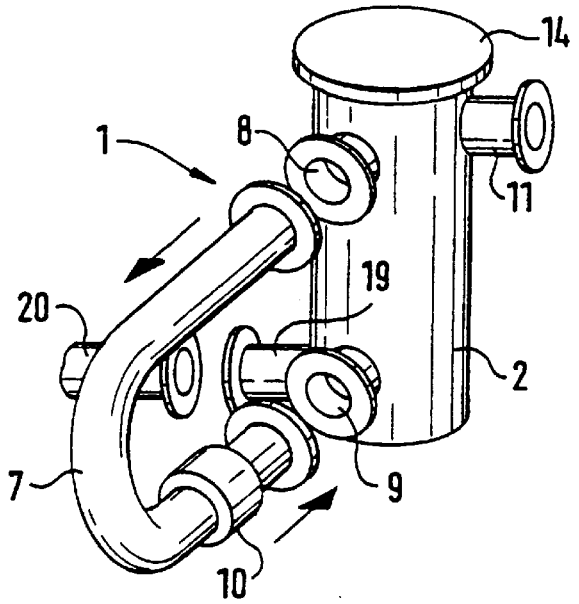
FIG. 3 A diagrammatic, perspective view of the ball collector with a different arrangement of the inlets and outlets compared with FIG. 2.

The plant shown in FIG. 2 is a preferred embodiment for the use of the ball collector 1, but without the latter being restricted thereto. The representation of the embodiment of FIG. 3 makes it clear that the inlet 11 can be displaced by 90° relative to the outlet 8 and inlet 9, which also applies with regards to the outlet 19.

The opening 4 is so dimensioned that an undisturbed sinking of the balls and the easy removal thereof from the lower chamber 6 by hand, following the removal of the lid 14 is ensured.

The ball collector is usable both continuously and for periodically operating cooling cycles.

Only the pump 10 requires an external drive, normally provided by an electric motor. The shutoff members in the form of the flap 16 and nonreturn valve 28 are flow-controlled and require no separate drive.

What is claimed is:

1. Ball collector for a device for returning balls for the cleaning of tubes (24) of cooling systems operated with a fluid, namely water, comprising a casing (2), which is subdivided into an upper chamber (5) with an inlet for the balls and in a lower chamber (6) with an outlet for the balls, in which between the upper and lower chambers (5; 6) is provided an opening (4), which is closable by a movable flap (16) in the closed position and is freeable in the open position thereof, the upper chamber (5) having a strainer screen (15) is connected to the lower chamber (6) by a bypass line (7) having a pump (P), through which water can be pumped from the upper chamber (5) into the lower chamber (6), characterized in that the flap (16) if the ball collector (1) is so constructed and positioned and freely pivotably mounted through the water flow between the open position and the closed position, that if the pump (10) in the bypass line (7) is switched on the flap (16) assumes its closed position and when the pump (10) is switched off its open position.

2. Ball collector according to claim 1, characterized in that the flap (16), if the pump (10) in the bypass line (7) is switched off at the end of a cleaning cycle, pivots from the closed position into the open position and frees the opening between the upper chamber (5) and the lower chamber (6), so that the balls collected in the upper chamber (5) sink into the lower chamber (6) and pivots from the open position back up into the closed position and closes the opening (4), if at the start of a cleaning cycle the pump (10) in the bypass line (7) is switched on.

3. Ball collector according to claim 1, characterized in that the flap (16) with respect to the inlet of the bypass line (7) into the lower chamber (6) is so arranged and constructed that the flap (16) in the open position on switching on the pump (10) is engaged by the water flow from the bypass line (7) and forced into the closed position.

4. Ball collector according to claim 3, characterized in that the size and weight of the flap (16) on the one hand and the pressure of the pump (10) on the other are so selected that the forces exerted by the water flow from the bypass line (7) on the flap (16) are sufficiently high to move the flap (16) into its closed position.

5. Ball collector according to claim 1, characterized in that a discharge line (20) can be shutoff at the end of a cleaning cycle, preferably by a shutoff member operated in motor manner or by the fluid and more particularly a nonreturn valve (28).

6. Ball collector according to claim 1, characterized in that the pump (10) if switched on and if the discharge line (12) is freed, overcomes the differential pressure between the inlet area (31) and the outlet area (25) of the heat exchanger (23) or the like, as well as the dynamic pressure losses of the supply line (12) and discharge line (20).

7. Ball collector according to claim 1, characterized in that springs are provided for assisting the pivoting movement of the flap (16).

8. Ball collector according to claim 1, characterized in that the inlet (8) of the bypass line (7) and the outlet (19) of the casing (2) are directly superimposed in the lower chamber (6).

9. Ball collector according to claim 1, characterized in that the bypass line (7) is displaced by 90° relative to the supply line (12) and discharge line (20) of the casing (2).

10. Ball collector according to claim 1, characterized in that the strainer screen (15) in the upper chamber (5) is substantially cylindrical at least in the vicinity of the opening (4) and the shape and size of its free cross-section are matched to the shape and size of the opening (4), at least at the lower end thereof.

11. Ball collector according to claim 1, characterized in that the flap (16) comprises a swivel bearing (17) which is fitted to the underside of an annular web (3), which forms the opening (4) and is fitted to the inside of the casing (2).

12. Ball collector according to claim 1, characterized in that the strainer screen (15) is fixed to the underside of a lid (14).

* * * * *